US012559886B2

(12) United States Patent
Einarsson

(10) Patent No.: US 12,559,886 B2
(45) Date of Patent: Feb. 24, 2026

(54) WOVEN FABRIC AND TECHNICAL TEXTILE

(71) Applicant: Voith Patent GmbH, Heidenheim (DE)

(72) Inventor: Johan Einarsson, Oerebro (SE)

(73) Assignee: Voith Patent GmbH, Heidenheim (DE)

( * ) Notice: Subject to any disclaimer, the term of this patent is extended or adjusted under 35 U.S.C. 154(b) by 625 days.

(21) Appl. No.: 17/440,884

(22) PCT Filed: Feb. 5, 2020

(86) PCT No.: PCT/EP2020/052817

§ 371 (c)(1),
(2) Date: Sep. 20, 2021

(87) PCT Pub. No.: WO2020/187480

PCT Pub. Date: Sep. 24, 2020

(65) Prior Publication Data

US 2022/0162800 A1 May 26, 2022

(30) Foreign Application Priority Data

Mar. 18, 2019 (DE) ..... 102019106769.3

(51) Int. Cl.
*D21F 7/08* (2006.01)
*D21F 7/10* (2006.01)

(52) U.S. Cl.
CPC ..... *D21F 7/083* (2013.01); *D21F 7/10* (2013.01)

(58) Field of Classification Search
CPC .... D21F 1/0027; D21F 1/0036; D21F 1/0045; D21F 1/0054; D21F 7/08; D21F 7/083; D21F 7/10; D21F 7/12
USPC ..... 162/348, 358.2, 900, 902, 903, 904; 139/383 A, 383 AA, 425
See application file for complete search history.

(56) References Cited

U.S. PATENT DOCUMENTS 4,518,644 A * 5/1985 Vuorio ..... B01D 39/083 162/903
5,025,839 A 6/1991 Wright
7,118,651 B2 10/2006 Aldrich

FOREIGN PATENT DOCUMENTS

| | | | | |
|---|---|---|---|---|
| DE | 8604525 U1 | | 4/1986 | |
| EP | 0425523 B1 | | 3/1995 | |
| EP | 1195462 A2 | | 4/2002 | |
| EP | 1462569 A2 | | 9/2004 | |
| GB | 2010346 A | | 6/1979 | |
| WO | WO 89/12717 | * | 12/1989 | ..... D21F 1/0054 |
| WO | 2004099496 A1 | | 11/2004 | |

* cited by examiner

*Primary Examiner* — Eric Hug
(74) *Attorney, Agent, or Firm* — Laurence A. Greenberg; Werner H. Stemer; Ralph E. Locher

(57) ABSTRACT

A woven fabric has warp threads and weft threads that are interwoven for configuring a textile structure. The woven fabric has a thickness direction as well as a warp direction and a weft direction. The warp threads and/or the weft threads in the thickness direction have a wave-shaped profile. At least some, preferably all, weft threads have a wave-shaped profile in the warp direction, and/or at least some, preferably all, warp threads have a wave-shaped profile in the weft direction. Moreover, a technical textile is formed from such a woven fabric.

17 Claims, 4 Drawing Sheets

WOVEN FABRIC AND TECHNICAL TEXTILE

FIELD AND BACKGROUND OF THE INVENTION

The invention relates to a woven fabric for a technical textile and to a technical textile, in particular a clothing of a machine for producing or processing a fibrous web.

Press felts for the use in paper manufacturing usually have a woven basic structure. It is often advantageous here for this basic structure to be constructed from two or more woven fabric plies so as to impart to the felt the required strength, for example, or else to make available a sufficient storage volume for the water that is squeezed out. When two woven fabric plies are combined with one another, the threads and the intermediate spaces of the first ply overlap the threads and the intermediate spaces of the second ply. When these are separate woven fabrics which are connected to one another, for example by needling, only after weaving, the threads will thus never be positioned exactly on top of one another. When the two fabrics are identical or very similar, this can lead to effects such as the known Moiré effect. This here leads to regions in the clothing in which the intermediate spaces of the two woven fabrics lie largely on top of one another, whereas in other regions the intermediate spaces of the one woven fabric ply are spanned by threads of the other woven fabric ply.

Various negative effects can arise as a result:

On the one hand, these regions have different degrees of permeability as a result of which non-uniform dewatering of the paper web ultimately arises.

On the other hand, the anchoring of the non-woven fibers of the felt is significantly improved in the regions where the intermediate spaces of the one woven fabric are covered by the threads of the other woven fabric. Non-uniform wear of the felt during the service life arises as a result. The effect of the non-uniform dewatering is even further amplified as a result. Various ideas for solving this issue are known from the prior art.

One potential solution lies in using woven fabrics with significantly different yarn densities for the two plies. As a result, the interference pattern which causes the Moiré effect becomes finer, and the visible effect is reduced. However, this significantly restricts the freedom of design in terms of the construction of the felt because the yarn density is an important parameter, for example for influencing the permeability of the felt.

Alternatively, EP 1 462 569 proposes that the two woven fabric plies are connected in that the warp threads of the upper ply are occasionally interwoven with weft threads of the lower ply, and vice versa. It can be achieved as a result that the intermediate spaces and the threads of the two plies are disposed so as to be exactly on top of one another and, as a result of the tightly woven connection, can also not slide out of place. A Moiré effect can thus be largely prevented. It is however disadvantageous here that special weaving looms are required for weaving these multi-ply structures. It has moreover been demonstrated that comparatively high warp tensions are required for weaving structures of this type, increased wear arising on the weaving looms as a result.

SUMMARY OF THE INVENTION

It is therefore an object of the present invention to propose a clothing in which the disadvantages as a result of Moiré effects are eliminated or at least greatly reduced, without being excessively restricted in terms of the design of the felt. It is moreover an object of the invention to propose a woven fabric which is simple to produce and can be used in the basic structure of such a clothing.

The objects are completely achieved by a woven fabric as claimed in the independent woven fabric claim as well as by a technical textile as claimed in the independent technical textile claim. Advantageous embodiments are set forth in the dependent claims.

In terms of the woven fabric the object is achieved by a woven fabric for a technical textile, in which woven fabric warp threads and weft threads are interwoven while configuring a textile structure, wherein the woven fabric has a thickness direction as well as a warp direction and a weft direction, wherein the warp threads and/or the weft threads in the thickness direction have a wave-shaped profile. It is provided according to the invention that at least some, preferably all, weft threads have a wave-shaped profile in the warp direction, and/or at least some, preferably all, warp threads have a wave-shaped profile in the weft direction.

As a consequence of the weaving process the warp threads in almost any woven fabric, and to a lesser extent also the weft threads, have a wave-shaped profile in the thickness direction of the woven fabric. In the woven fabric according to one aspect of the invention it is now provided that at least some of the threads have a wave-shaped profile also in the plane defined by the warp direction and the weft direction.

It is to be pointed out here that the term "wave-shaped" in the context of this patent application is not to be restricted to a sinusoidal profile. Said term is rather intended to comprise also other uniformly meandering or largely uniformly meandering profiles, in particular also a "zigzag" profile.

This leads to the high degree of uniformity of the woven fabric structure, which during superimposing leads to the Moiré effect, being intercepted.

In a classic plain weave, for example, there are thus intermediate spaces which are all identical and approximately square. In contrast, when one weft thread or both of the weft threads has/have, respectively, a zigzag-shaped profile with a period length of eight warp threads, for example, trapezoidal intermediate spaces having eight different shapes and dimensions are created as a result.

A woven fabric having a uniformity of the structure that is interrupted in such an intense manner can be superimposed using almost any other woven fabric without a notable Moiré effect being created here.

The woven fabric can be very readily adapted to the required intended use by way of the type and the intensity of the wave-shaped profile of the threads.

Woven fabrics according to one aspect of the invention are therefore very well suitable for the use in multi-ply clothings, in particular in the manufacture of paper, cardboard, tissue or non-woven products.

However, a woven fabric of this type is also able to be advantageously used in other sectors where said woven fabric can be used individually or in combination with a further woven fabric. Industrial textiles as well as applications in the apparel industry or in the home textiles sector are conceivable.

It can preferably be provided that in a wave-shaped profile of the weft threads in the warp direction the spacing of two adjacent weft threads at locations drops to less than 50%, in particular to less than 30%, of the mean spacing of these weft threads.

Alternatively or additionally, it can be provided that in a wave-shaped profile of the warp threads in the weft direction the spacing of two adjacent warp threads at locations drops to less than 50%, in particular to less than 30%, of the mean spacing of these warp threads.

A reduction of the spacing of two adjacent threads of this type can be achieved, for example, when these threads have the same wave-shaped profile but are offset by half a period, for example.

In particularly preferred embodiments it can be advantageous for two adjacent warp threads or weft threads to contact one another at some locations. It can even be provided that a warp thread or a weft thread, respectively, contacts both adjacent threads.

Suitable methods for producing such woven fabrics are described in the context of the figures.

All usual fibrous materials can be used as a thread material, in particular polymer fibers or else natural fibers such as, for example, wool fibers and cotton fibers, and even metal filaments.

The woven fabrics can be, for example, a flat-woven fabric or a circular-woven fabric.

The warp threads and/or weft threads advantageously have a circular cross section.

Preferred diameters of the warp threads and/or weft threads are between 0.3 mm and 0.5 mm, particularly preferably are 0.4 mm.

The following example is intended to explain once again the structure of a woven fabric according to one aspect of the invention. The invention is however not limited to this example. In the case of a typical weft thread density of 750 threads/meter, a spacing of the centers of adjacent weft threads of 1000/750~1.3 mm results. When weft threads having a diameter of 0.4 mm are used, the adjacent threads thus have a spacing of (1.3 mm−0.4 mm=0.9 mm). This corresponds to the mean mutual spacing of these weft threads. When the weft threads in the woven fabric now have a wave-shaped profile in the warp direction, this spacing can at times thus become somewhat larger and at times somewhat smaller. When the spacing drops to 30% of the mean spacing, for example, as described in one advantageous embodiment, locations where two adjacent weft threads have a spacing of merely 0.9 mm*30%=0.27 mm thus arise. In order for a mean spacing of 0.9 mm to be maintained, these threads at other locations have a larger mutual spacing. In the case of a uniform wave-shaped profile, the spacing in this example can increase up to 0.9 mm*170%=1.53 mm.

In terms of the technical textile, the object is achieved by a technical textile, in particular a clothing of a machine for producing or processing a fibrous web, wherein the technical textile comprises at least a first woven fabric according to one aspect of the invention.

In preferred embodiments it can be provided that the technical textile has two woven fabric plies which are disposed on top of one another.

In a very advantageous embodiment it can be provided that the two woven fabric plies are associated with the same woven fabric which by folding is placed on top of itself. Woven fabric structures of the type which can be used as a basic structure for multi-ply seam felts are described in the patent document EP 0 425 523. Because the woven structure of both plies by virtue of the construction of the latter is identical in such textiles, the risk of Moiré effects is particularly high. At the same time, however, the known countermeasures such as interweaving the two plies, or the use of different weaving patterns, cannot be applied. The advantage in terms of textiles of this type, in particular in terms of the seam felts mentioned, is thus particularly great when a woven fabric according to one aspect of the invention is used.

Alternatively or additionally, it can be provided that the technical textile comprises a second woven fabric, in particular a second woven fabric according to one aspect of the invention, and the first woven fabric provides the first woven fabric ply, while the second woven fabric provides the second woven fabric ply. In contrast to the embodiment described above, two independent woven fabrics here are provided for the two woven fabric plies. The first woven fabric and the second woven fabric here can be identical woven fabrics or different woven fabrics.

The invention is however not limited to single-ply or two-ply structures. It can in particular be provided that the technical textile also has one or a plurality of further plies which are connected to at least one of the first or the second woven fabric ply.

One or a plurality of the further plies can in particular be a further woven fabric, a non-woven ply, a warp-knitted and/or weft-knitted fabric, or a fiber mat.

In advantageous embodiments it can be provided that the first woven fabric is a flat-woven fabric, wherein the warp threads of the first woven fabric are disposed in the machine running direction of the technical textile.

In other advantageous embodiments it can be provided that the first woven fabric is a circular-woven fabric, wherein the weft threads of the first woven fabric are disposed in the machine running direction of the technical textile.

A preferred application for the technical textile lies in the use as a press felt, in particular also in the form of a seam felt.

The invention will be explained in more detail hereunder by means of schematic figures.

DETAILED DESCRIPTION OF THE INVENTION

Figure 1:
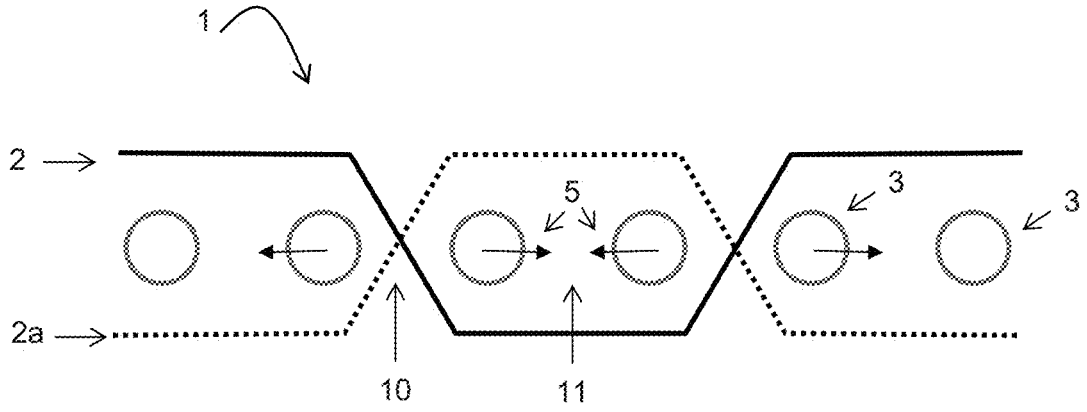
FIG. 1 schematically shows a section through a woven fabric according to one aspect of the invention.

The woven fabric shown in FIG. 1 is constructed from warp threads 2, 2*a* and weft threads 3. The weft threads 3 here are in each case combined so as to form groups of two threads. The two warp threads 2 and 2*a* here are adjacent warp threads. In this weaving pattern, there are changeover points 10 in which the warp threads 2, 2*a* between two adjacent weft threads 3 change from the top to the bottom or vice versa, while no warp threads 2, 2*a* run between two adjacent weft threads 3 at other locations 11. As a result of the space requirement of the warp threads 2, 2*a* at the changeover points 10, a force effect acts on the weft threads in a displacement direction 5.

Figure 2A:
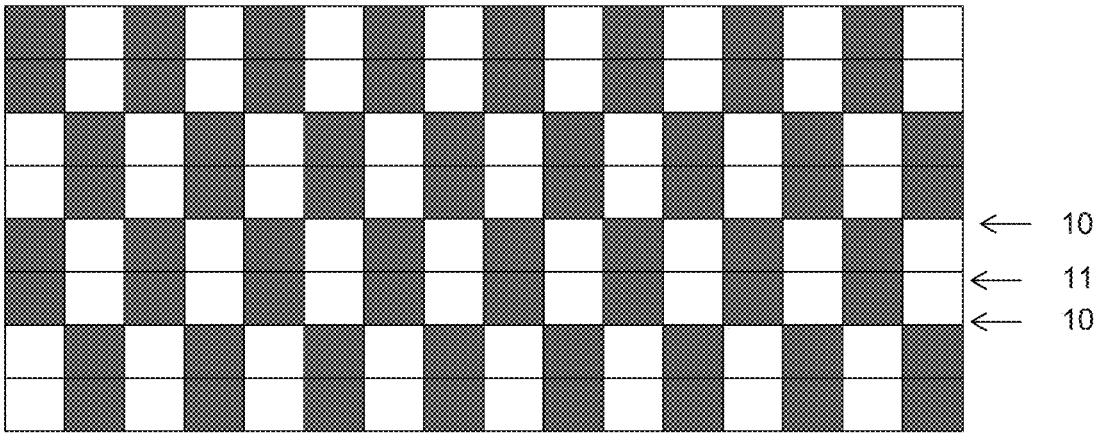
FIG. 2A (PRIOR ART)
FIGS. 2*a* and 3*a* show a weaving pattern card for the known Half Panama weaving pattern.

As is customary in weaving pattern cards, FIGS. 2*a*/2*b* as well as 3*a*/3*b* are aligned such that the warp threads 2, 2*a* run from the bottom to the top, and the weft threads 3 run transversely thereto. Swapping these directions also leads to a woven fabric according to another aspect of the invention in which the warp threads 2, 2*a* have a wave-shaped profile in the weft direction.

Figure 2B:
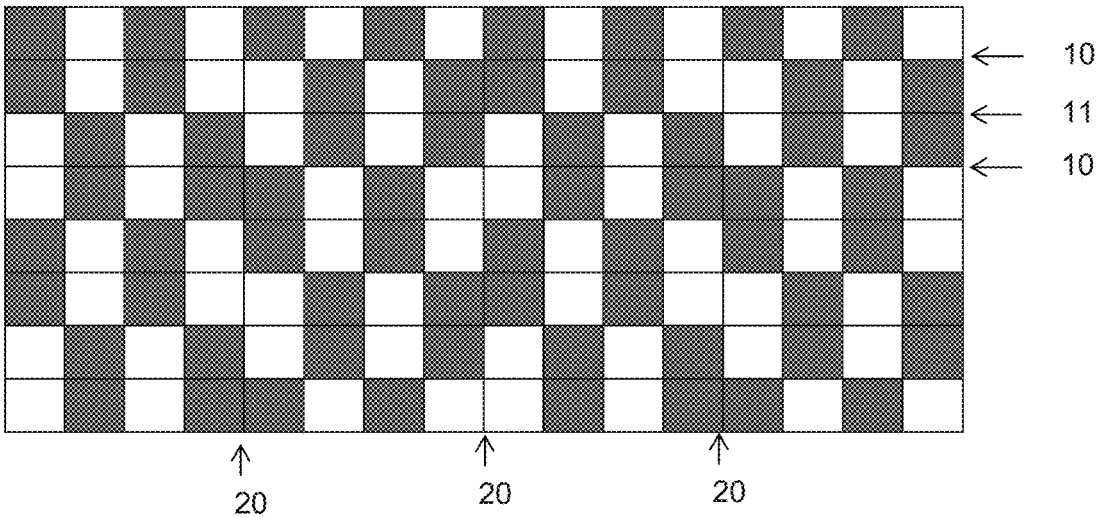
FIGS. 2*b* and 3*b* show a weaving pattern card for a weaving pattern according to one aspect of the invention.
Figure 3A:
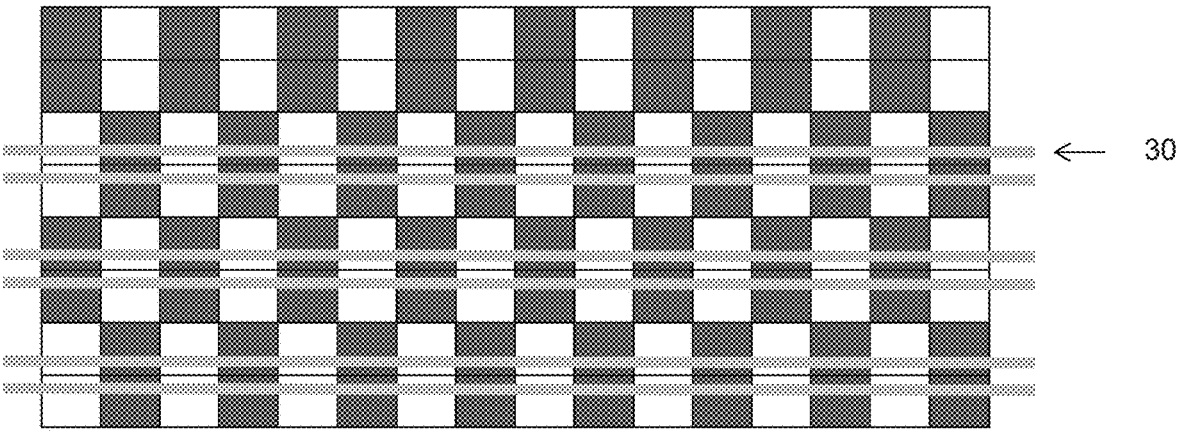
FIG. 3A (PRIOR ART)
Figure 3B:
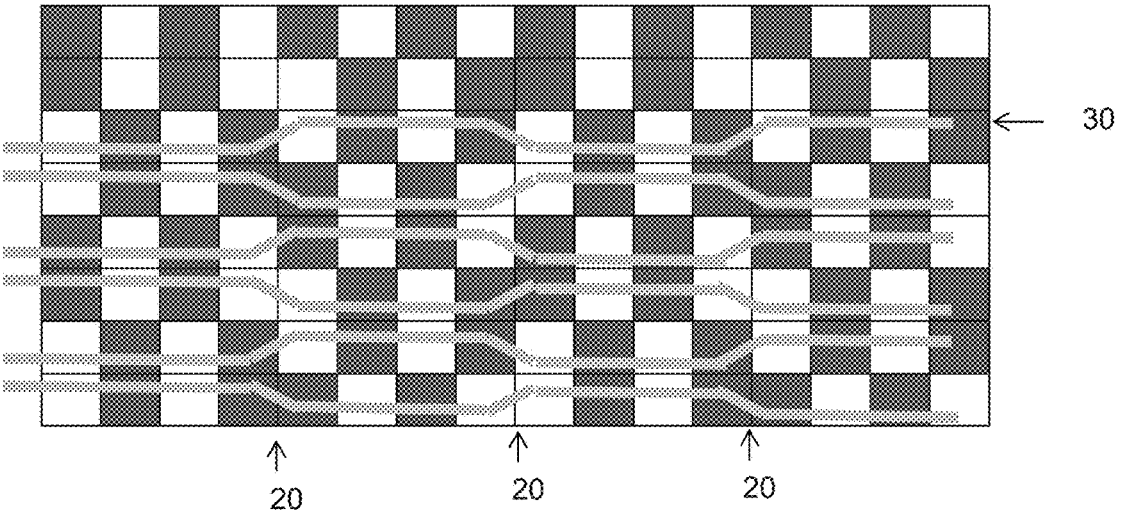

In the known "Half Panama" weaving pattern illustrated in FIGS. 2*a* and 3*a*, respectively, these changeover points 10 are at all times disposed between the same weft threads. As is indicated in FIG. 3*a*, the profile 30 of the weft threads 3 is therefore substantially rectilinear. A modification of the Half Panama is illustrated in FIGS. 2*b* and 3*b*, respectively, said modification delivering a woven fabric according to one aspect of the invention. As in the known Half Panama, two weft threads are in each case grouped together again. It is new here that one weft thread 3 is grouped alternatingly with the one and the other adjacent weft thread 3. This grouping changeover 20 in FIGS. 2*b*/3*b* takes place regularly after each fourth warp thread. While this type of the grouping changeover 20 has often proven to be advantageous, the invention is however not limited thereto. The weft profile 30 resulting therefrom is schematically plotted in FIG. 3*b*. The displacement direction 5 in which the weft thread 3 is displaced changes at the locations of the grouping changeover 20. The displacement 5 thus takes place in an alternating manner, once toward the upper and once toward the lower adjacent thread. A wave-shaped profile of the weft threads 3 in the warp direction be achieved in this way.

It can be readily derived that, using the technique described above, a wave-shaped profile of the warp threads 2, 2*a* in the weft direction can also be achieved in an analogous manner in that two warp threads 2, 2*a* are grouped instead of two weft threads 3.

Figure shows a microscopic image of a woven fabric 1 as described in FIGS. 2*b* and 3*b*. The changeover of the grouping 20 again takes place after each fourth warp thread 2, 2*a*. The wave-shaped profile of the weft threads 3 in the warp direction here can be readily seen. This spacing of two adjacent weft threads 3 in this example varies such that adjacent weft threads 3 contact one another at some locations. One weft thread 3 here alternatingly contacts both adjacent weft threads 3.

The intensity, or the amplitude, respectively, of this wave-shaped profile can be influenced by various factors. In principle, the stiffness of the threads (here the weft threads 3) counteracts the displacement 5 described. A higher stiffness of the thread material used therefore tends to lead to smaller amplitudes. Likewise, a smaller spacing of the grouping changeovers 20 leads to smaller amplitudes. When a grouping changeover 20 is carried out after each warp thread 2, 2*a* (or after each weft thread 3 in the embodiment having a wave-shaped profile of the warp threads 2, 2*a* in the weft direction), the stiffness of the weft thread 3 then be so high that said weft thread 3 does not display any wave-shaped profile. In particular, the spacing of two adjacent weft threads 3 in this instance will not drop to less than 50%, in particular to less than 30%, of the mean spacing of these weft threads. Conversely, the desired wave-shaped profile in the case of stiffer threads can also be achieved by a larger spacing of the grouping changeovers 20. Such grouping changeovers 20 can be carried out, for example, every 2, 3, 4, 5, 6 or more (warp) threads.

Figure 4:
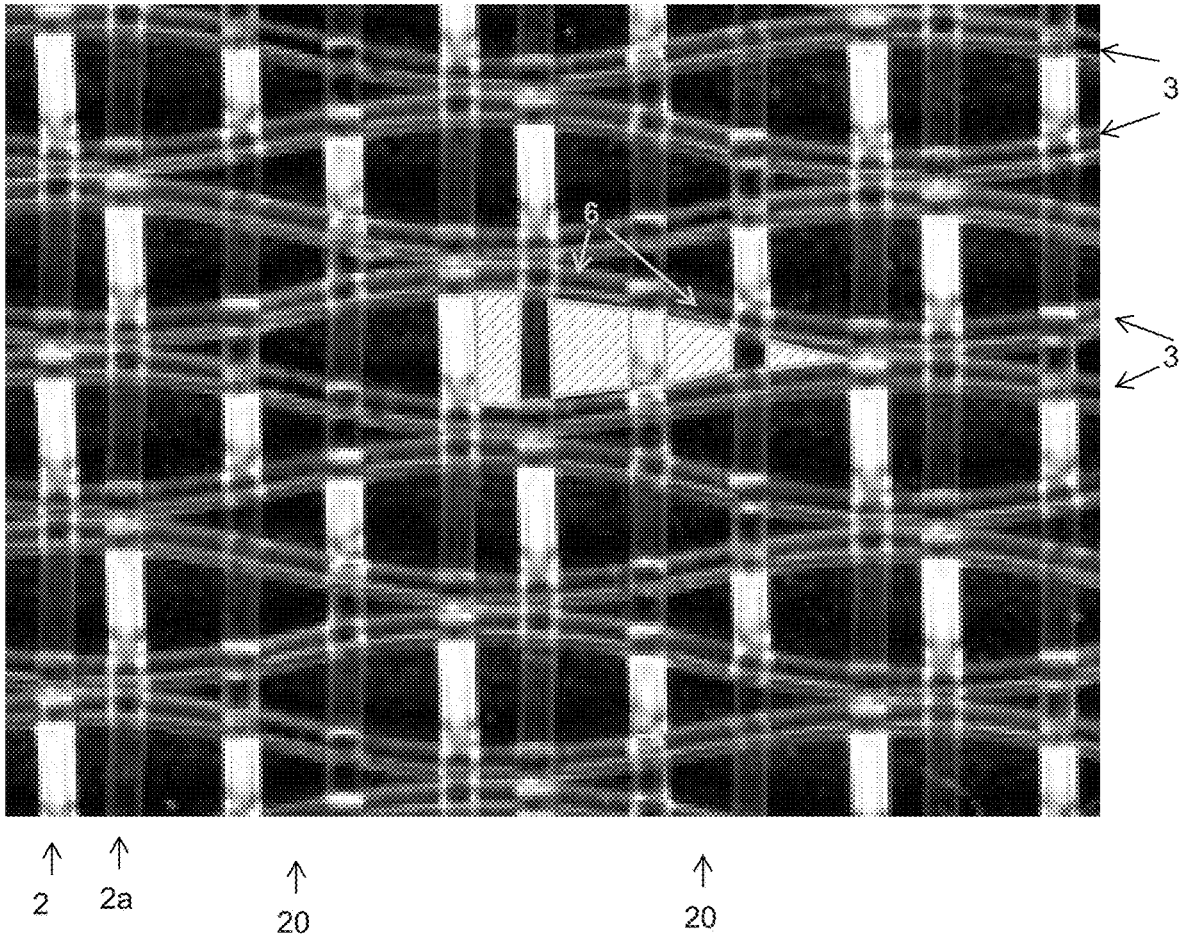
FIG. 4 shows a microscopic image of a woven fabric according to FIGS. 2*b* and 3*b*, respectively.

FIG. 4 also shows very well how intensely the intermediate spaces 6 which are created between the threads 2, 2*a*, 3 differ. In the case of one such woven fabric 1 being superimposed by itself or by another woven fabric, the risk of the Moiré effect arising is largely precluded. The other woven fabric here can indeed also be conventionally woven and have regular, rectangular intermediate spaces.

Figure 5:
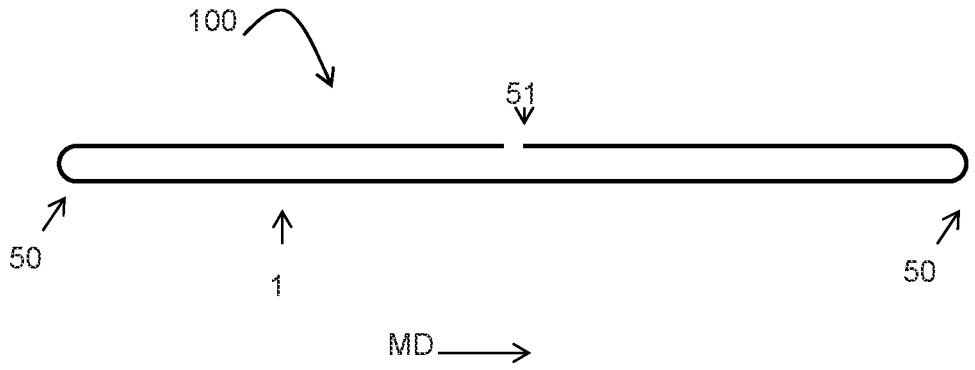
FIG. 5 shows a technical textile according to one aspect of the invention.

FIG. 5 shows a technical textile 100 according to one aspect of the invention. The technical textile 100 can be used, for example, as a clothing 100 for a paper machine. The woven fabric 1 here is embodied according to one aspect of the invention. A flat-woven fabric 1 which has double the length of the desired textile 100 is used here. The warp direction is usually the longitudinal direction of the woven fabric. When used as a clothing, the warp direction is then the machine direction MD. The woven fabric 1 is preferably single-ply. A two-ply textile 100 is created by depositing the woven fabric 1 onto itself. The folds here can be configured so as to form seam loops 50. Some weft threads 3 can be removed in order for these seam loops 50 to be configured. The textile 100 can be rendered continuous by crossing the two seam loops 50 into one another and connecting the latter by means of a pintle. The face-side ends of the woven fabric 1 are usually disposed such that said ends contact one another at a butt joint 51 or overlap one another. Said ends here can be connected, in particular also welded.

The two woven fabric plies can optionally be connected to one another. This can take place inter alia by sewing or adhesive bonding.

In addition to the two-ply woven fabric 1 shown in FIG. 5, the technical textile 100 can also comprise even further components. When the technical textile 100 is used as a press felt 100 in a paper machine, for example, plies from non-woven fibers are usually provided on one side or both sides. These non-woven plies can be connected to one another and to the woven fabric 1 by needling. The probability of two comparatively large open faces coming to lie on top of one another is reduced as a result of the irregular intermediate spaces 5. As described at the outset, improved anchoring of the non-woven fibers in the woven fabric 1 is achieved as a result.

Figure 6:
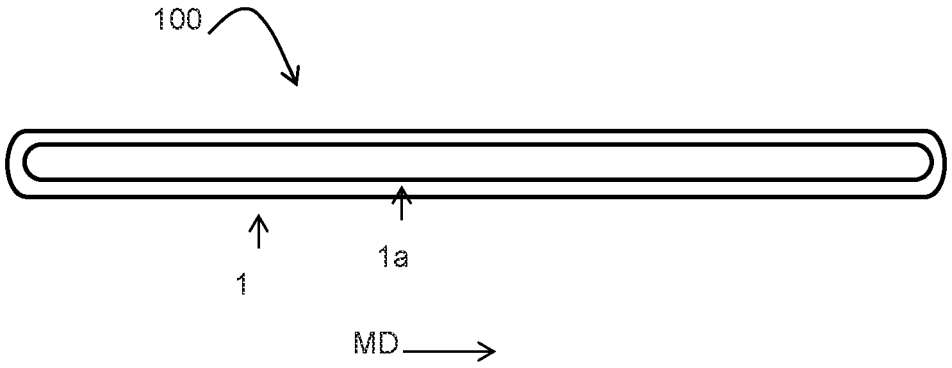
FIG. 6 shows a technical textile according to a further aspect of the invention.

FIG. 6 shows a textile 100 having a woven fabric 1 according to a further aspect of the invention. This textile is constructed from a first woven fabric 1 and a second woven fabric 1*a*. Both woven fabrics 1, 1*a* in this example are of a circular-woven construction. When used as a clothing, the weft direction is then the machine direction MD. The first woven fabric 1 forms the first woven fabric ply, and the second woven fabric 1*a* forms the second woven fabric ply. It can be provided that the first woven fabric 1, the second woven fabric 1*a*, or both woven fabrics 1, 1*a* is/are embodied according to one aspect of the invention. Further plies, in particular non-woven plies, can also be provided here.

LIST OF REFERENCE SIGNS

First woven fabric
1*a* Second woven fabric
2, 2*a* Warp thread
3 Weft thread
5 Displacement direction
6 Intermediate space
10 Changeover point
11 No warp change
20 Grouping changeover point
30 Weft profile
100 Technical textile

The invention claimed is:

1. A technical textile, comprising:

at least a first fabric having warp threads and weft threads being interwoven forming a textile structure, wherein said first fabric having a thickness direction as well as a warp direction and a weft direction, wherein said warp threads and/or said weft threads in the thickness direction have a wave-shaped profile, wherein at least some of said weft threads have a wave-shaped profile in the warp direction, and/or at least some of said warp threads have a wave-shaped profile in the weft direction; and two woven fabric plies being disposed on top of one another, said two woven fabric plies are associated with a same woven fabric which by folding is placed on top of itself forming said two woven fabric plies.

2. The technical textile according to claim 1, further comprising a second woven fabric, said second woven fabric woven fabric being conventionally woven with regular, rectangular intermediate spaces.

3. The technical textile according to claim 1, wherein said same woven fabric which by folding is placed on top of itself is said first woven fabric.

4. The technical textile according to claim 1, wherein in said wave-shaped profile of said weft threads of said first woven fabric in the warp direction, a spacing of two adjacent said weft threads in locations drops to less than 50% of a mean spacing of said weft threads.

5. The technical textile according to claim 1, wherein in said wave-shaped profile of said warp threads of said first woven fabric in the weft direction, a spacing of two adjacent warp threads at locations drops to less than 50% of a mean spacing of said warp threads.

6. The technical textile according to claim 2, further comprising at least one further ply being connected to at least one of said two woven fabric plies.

7. The technical textile according to claim 6, wherein said at least one further ply is one of a plurality of further plies, at least one of said further plies is a woven fabric, a non-woven ply, a warp-knitted and/or weft-knitted fabric, or a fiber mat.

8. The technical textile according to claim 1, wherein said first woven fabric is a flat-woven fabric, wherein said warp threads of said first woven fabric are disposed in a machine running direction of the technical textile.

9. The technical textile according to claim 8, wherein:

a diameter of said warp threads is between 0.3 mm and 0.5 mm; and said weft threads have the wave-shaped profile in the warp direction.

10. The technical textile according to claim 1, wherein said first woven fabric is a circular-woven fabric, and said weft threads of said first woven fabric are disposed in a machine running direction of the technical textile.

11. The technical textile according to claim 1, wherein the technical textile is a press felt.

12. The technical textile according to claim 1, wherein the technical textile is a seam felt.

13. The technical textile according to claim 9, wherein said diameter of said warp threads is 0.4 mm.

14. The technical textile according to claim 1, wherein in said wave-shaped profile of said weft threads of said first woven fabric in the warp direction, a spacing of two adjacent said weft threads in locations drops to less than 30% of a mean spacing of said weft threads.

15. The technical textile according to claim 1, wherein:

the technical textile is a clothing of a machine for producing or processing a fibrous web; and all of said weft threads have the wave-shaped profile in the warp direction, and/or all of said warp threads have the wave-shaped profile in the weft direction.

16. The technical textile according to claim 1, wherein the wave-shaped profile is a symmetrical and continuously repeating profile.

17. The technical textile according to claim 16, wherein the wave-shaped profile has a grouping changeover that defines a wavelength of the wave-shaped profile, the wavelength being at least 4 threads.

* * * * *